United States Patent [19]

Hagel et al.

[11] Patent Number: 4,581,082

[45] Date of Patent: Apr. 8, 1986

[54] PRIMER CHARGES FREE OF LEAD AND BARIUM

[75] Inventors: Rainer Hagel, Lichtenfels; Klaus Redecker, Nuremberg, both of Fed. Rep. of Germany

[73] Assignee: Dynamit Nobel Aktiengesellschaft, Troisdorf, Fed. Rep. of Germany

[21] Appl. No.: 621,684

[22] Filed: Jun. 18, 1984

[30] Foreign Application Priority Data

Jun. 18, 1983 [DE] Fed. Rep. of Germany ..... 3321943

[51] Int. Cl.[4] ..... C06B 25/04

[52] U.S. Cl. ..... 149/105; 149/37; 149/44; 149/95; 149/97; 149/98; 149/88

[58] Field of Search ..... 149/37, 44, 88, 105, 149/95, 97, 98

[56] References Cited

U.S. PATENT DOCUMENTS

| | | | |
|---|---|---|---|
| 3,862,866 | 1/1975 | Timmerman et al. | 149/21 |
| 4,209,351 | 6/1980 | Pierce et al. | 149/19.1 |
| 4,363,679 | 12/1982 | Hagel et al. | 149/37 |

*Primary Examiner*—Stephen J. Lechert, Jr.

*Attorney, Agent, or Firm*—Antonelli, Terry & Wands

[57] ABSTRACT

A primer charge containing an oxidizing agent and an initiating explosive. The charge contains as the oxidant zinc peroxide and as the initiating explosive diazodinitrophenol and/or a strontium salt of mono- and/or dinitrodihydroxydiazobenzene. In correspondence with the content of the strontium salt employed, the charge can also be utilized with low tamping; alternatively, such tamping can be selected at will. The charge is furthermore distinguished by lead-free and barium-free combustion products so that the charge does not exhibit the properties which make the heretofore known primer charges deleterious to the health of humans.

7 Claims, No Drawings

PRIMER CHARGES FREE OF LEAD AND BARIUM

The present application concerns primer charges having reduced emission of pollutants. Especially, emission of lead and its compounds is entirely prevented in these charges since they do not contain any lead compounds. In addition, these charges can be utilized with variable tamping.

The conventional primer charges contain, as the initiating explosives, lead salts derived from di- and trinitroresorcinol, trinitrophenols, or from hydrazoic acid. Moreover, primer charges are also known which contain double salts of lead, for example, lead nitrate hypophosphite.

During deflagration of these primer charges, increased concentrations of lead and its compounds, which can frequently surpass the permissible concentrations, occur in the surrounding air in the closed shooting ranges recently installed to an increased extent to reduce noise emission. At this time, the permissible lead concentration is 0.1 $mg/m^3$. This concentration can be reached, in unfavorable instances, even after only small number of shots.

Analogous considerations apply for the barium content of primer charges. Barium compounds are frequently used in the primer materials as oxidants in the form of barium nitrate or barium peroxide; these compounds, after deflagration, likewise contaminate the air and cause danger to the health of persons shooting in the aforementioned rifle ranges.

Therefore, the object resides in developing primer charges which, after their deflagration, do not release emissions harmful to one's health in the form of lead and barium compounds. Furthermore, the novel primer charges are to be usable at variable tamping.

In an attainment of this object, primer charges have now been found made up of initiating explosives in a mixture with oxidants, characterized in that the charges contain, as the initiating explosive, diazodinitrophenol and/or a strontium salt of mono- and/or dinitrodihydroxydiazobenzene, and zinc peroxide as the oxidant.

Surprisingly, the primer charges of this invention, even if they contain additional diazodinitrophenol as initiating explosive, can be utilized with no tamping at all, or with an only weak tamping. Diazodinitrophenol-zinc peroxide primer charges are especially well suited for the strongly self-tamped anvil primer cap systems, although diazodinitrophenol has only a small bulk density, which provides an obstacle, to using this compound in primer charges. In primer charge systems with relatively low inherent tamping, or in primer charge systems where the compacting of the diazodinitrophenol (diazole) is inadequate for complete ignition, the diazole is replaced partially or entirely by a strontium salt of mono- or dinitrodihydroxydiazobenzene, hereinbelow also denoted as strontium diazinate. By varying the diazinate content, it is thus possible to produce primer charges effecting complete ignition at any desired compacting or tamping.

The proportion of the mixture of diazole/diazinate in the primer charges of this invention can fluctuate between 5 and 70% by weight, depending upon the purpose for which the charge is utilized. In this connection, the two components can be in any desired ratio with respect to each other; if desired, one of these two initiating explosives can even be entirely missing from the charge, depending upon the tamping and the intended application.

The diazinates utilized in accordance with this invention are described in U.S. Pat. No. 4,246,052. In this reference, processes for the preparation thereof are also set forth. The compounds themselves should be handled only together with suitable passivators. This holds true, in particular, for the potassium salt which may not be employed without the concomitant use of a suitable passivator. Strontium sulfate or strontium oxalate is recommended as a passivator for the strontium salt. The quantity of the passivator in the diazi-rate can be up to 50%, with regard to the weight of the diazinate.

The oxidant used in the primer charges of this invention is zinc peroxide. This compound has preferably a high active oxygen proportion ( e.g. more than 12.3%). Production of such a zinc peroxide is disclosed in U.S. Pat. No. 4,363,679.

The quantity of zinc peroxide in the primer charges of this invention can very between 10 and 70% by weight. The zinc peroxide can be used in a fine-grained condition as well as in a coarse-particulate form. Fine-grained zinc peroxide having an average particle size of about 10 $\mu m$ is used with preference in case the primer charges are employed as compressed charges; whereas coarse-grained zinc peroxide with an average particle size of about 30 $\mu m$ is especially suited for less strongly compacted charges, for example in rim fire charges. The new primer charges contain the mixture of zinc peroxide and diatol/diazinate of at least 15 percent of weight. The preferred content of this mixture in the charge is 60–90 percent of weight.

The primer charges of this invention can contain, as the additional sensitizer, tetrazene up to an amount where the tetrazene content in the total mixture is maximally 30% by weight.

The primer charges of the present invention can furthermore contain additionally reducing agents or other ingredients contributing toward a reaction, as well as friction agents and other inert materials.

Suitable reducing agents are the conventional primer charge reducing media affecting an improvement in ignition capability and, in part, also an increase in mechanical sensitivity. Suitable substances are, for example, metallic powders of titanium, zirconium, magnesium, cerium-magnesium, cerium-silicon, or aluminum-magnesium alloys. Several reducing agents can simultaneously also fulfill the function of a friction agent, such as, for instance, antimony sulfide or calcium silicides. The proportion of reducing agents in the primer charge can be 0–10% by weight.

Friction media which do not participate in the reaction during deflagration can be present in the primer charges of this invention in amounts of up to 35% by weight. Such friction media are also known, per se. One example is glass powder.

Suitable further ingredients, contributing toward the reaction, are primarily secondary explosives, such as, for example, nitrocellulose or pentaerythrol tetranitrate. Another example that can be cited is octogen, as well as amino compounds of nitrated aromatics; e.g., of trinitrobenzene, such as mono-, di-, or triaminotrinitrobenzene or diaminohexanitrodiphenyl, furthermore, the acylation products of these compounds, such as, for example, hexanitrooxanilide or hexanitrodiphenylurea. Further examples for these secondary explosives are hexanitrostilbene, hexanitrodiphenyl oxide, hexanitrodiphenyl sulfide, hexanitrodiphenylsulfone, and hexanitrodiphenylamine, as well as tetranitrocarbazole, tetraintroacridone, or polyvinyl nitrate. The proportion of these compounds in the primer charge can be 0–30% by weight.

Suitable inert materials are the substances known, per se, in primer systems, frequently also employed for adapting the properties of these primer charges to the respective purpose for which they are used. One example is tin dioxide. Also among the inert materials are binders, adhesives, and coloring agents, as well as the above-cited passivators. The proportion of inert materials in the primer charges of this invention can range between 0 and 20% by weight.

The primer charges of the present invention are produced according to conventional methods by screening the dry mixture or by kneading the water-moist mixture. Measuring out of the water-moist composition can be accomplished by spreading same into perforated plates or by extrusion.

The invention will be described in greater detail by the following examples.

EXAMPLE 1

This example describes a primer charge which can be advantageously charged, for example, with good self-tamping into an anvil primer cap, 4.45 mm.

A mixture of 5 parts by weight of tetrazene, 20 parts by weight of diazole, 50 parts by weight of fine-grained zinc peroxide, 5 parts by weight of pulverized titanium, and 20 parts by weight of double-base ball powder with 22 parts by weight of water is homogenized and measured out by spreading the composition into perforated plates. After charging into primer caps, the composition is dried, subsequently compacted, and the primer cap finished. Sensitivity and firing results are comparable to those of a conventional primer charge.

EXAMPLE 2

This example describes a primer charge which can be suitably charged, for example, into propellant cartridges 6.8/11 rim tire with low self-tamping.

A mixture of 8 parts by weight of tetrazene, 28 parts by weight of strontium diazinate, plus 7 parts by weight of strontium sulfate, 40 parts by weight of coarse-grained zinc peroxide, 16 parts by weight of glass powder, and 1 part by weight of a binder used on polyvinyl acetate is homogenized with 22 parts by weight of water, measured out by spreading into perforated plates, and introduced in the moist stage by centrifugal action into propellant cartridges. After drying, the propellant charge powder is loaded and the ammunition subjected to a finishing step.

Sensitivity and ram power correspond to those of conventional ammunition.

What is claimed is:

1. A lead-free and barium-free primer charge which can be utilized without tamping, said charge containing, as an initiating explosive, a strontium salt of mono- and/or dinitrodihydroxydiazobenzene; as a passivator strontium sulfate or strontium oxalate; as an oxidant, zinc peroxide and as a sensitizer tetrazene.

2. A lead-free and barium-free primer charge according to claim 1, wherein the amount of initiating explosive is between 5 and 70% by weight and the amount of zinc peroxide is between 10 and 70% by weight within said primer charge.

3. A lead-free and barium-free primer charge according to claim 2, wherein said charge contains tetrazene in amounts of up to 30% by weight.

4. A lead-free and barium-free primer charge according to claim 1, wherein the zinc peroxide has an active oxygen content of above 12.3%.

5. A lead-free and barium-free primer charge according to claim 2 wherein said charge additionally contains diazodinitrophenol.

6. A lead-free and barium-free primer charge according to claim 1, wherein said charge contains as the initiating explosive a strontium salt of mono- and/or dinitrodihydroxydiazobenzene and as the oxidant zinc oxide.

7. A lead-free and barium-free primer charge according to claim 1, wherein said charge contains the passivator in an amount up to 50% by weight of the strontium salt acting as the initiating explosive.

* * * * *